US010526551B2

(12) United States Patent
Oprins

(10) Patent No.: US 10,526,551 B2
(45) Date of Patent: Jan. 7, 2020

(54) PROCESS FOR PRODUCING C2 AND C3 HYDROCARBONS

(71) Applicant: SABIC Global Technologies B.V., Bergen op Zoom (NL)

(72) Inventor: Arno Johannes Maria Oprins, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/061,393

(22) PCT Filed: Dec. 15, 2015

(86) PCT No.: PCT/EP2015/079828
§ 371 (c)(1),
(2) Date: Jun. 12, 2018

(87) PCT Pub. No.: WO2017/101985
PCT Pub. Date: Jun. 22, 2017

(65) Prior Publication Data

US 2019/0040327 A1 Feb. 7, 2019

(30) Foreign Application Priority Data

Dec. 22, 2014 (EP) ..... 14199591

(51) Int. Cl.
*C10G 65/10* (2006.01)
*C10G 47/10* (2006.01)
(Continued)

(52) U.S. Cl.
CPC ..... *C10G 65/18* (2013.01); *C10G 47/10* (2013.01); *C10G 65/00* (2013.01); *C10G 65/10* (2013.01);
(Continued)

(58) Field of Classification Search
CPC ..... C10G 65/18
(Continued)

(56) References Cited

U.S. PATENT DOCUMENTS 3,256,176 A 6/1966 Mills et al.
3,260,663 A 7/1966 Inwood et al.
(Continued)

FOREIGN PATENT DOCUMENTS

EP 0023802 A1 2/1981
GB 1148967 A 4/1969
(Continued)

OTHER PUBLICATIONS

"Molecular Sieves"; Kirk Othmer Encyclopedia of Chemical Technology; Fifth Edition, vol. 16; 2006; pp. 811-853.
(Continued)

*Primary Examiner* — Philip Y Louie
(74) *Attorney, Agent, or Firm* — Norton Rose Fulbright US LLP

(57) ABSTRACT

A process for producing C2 and C3 hydrocarbons by a) subjecting a mixed hydrocarbon stream comprising a middle distillate to first hydrocracking to produce a first hydrocracking product stream, b) subjecting a second hydrocracking feed stream to second hydrocracking to produce a second hydrocracking product stream, wherein the second hydrocracking is more severe than the first hydrocracking and c) subjecting a C4 hydrocracking feed stream to C4 hydrocracking optimized for converting C4 hydrocarbons into C3 hydrocarbons in the presence of a C4 hydrocracking catalyst to obtain a C4 hydrocracking product stream, wherein the C4 hydrocracking is more severe than the second hydrocracking. The first hydrocracking product stream, the second hydrocracking product stream and the C4 hydrocracking product stream are fed to a separation system.

20 Claims, 3 Drawing Sheets

Figure 1:
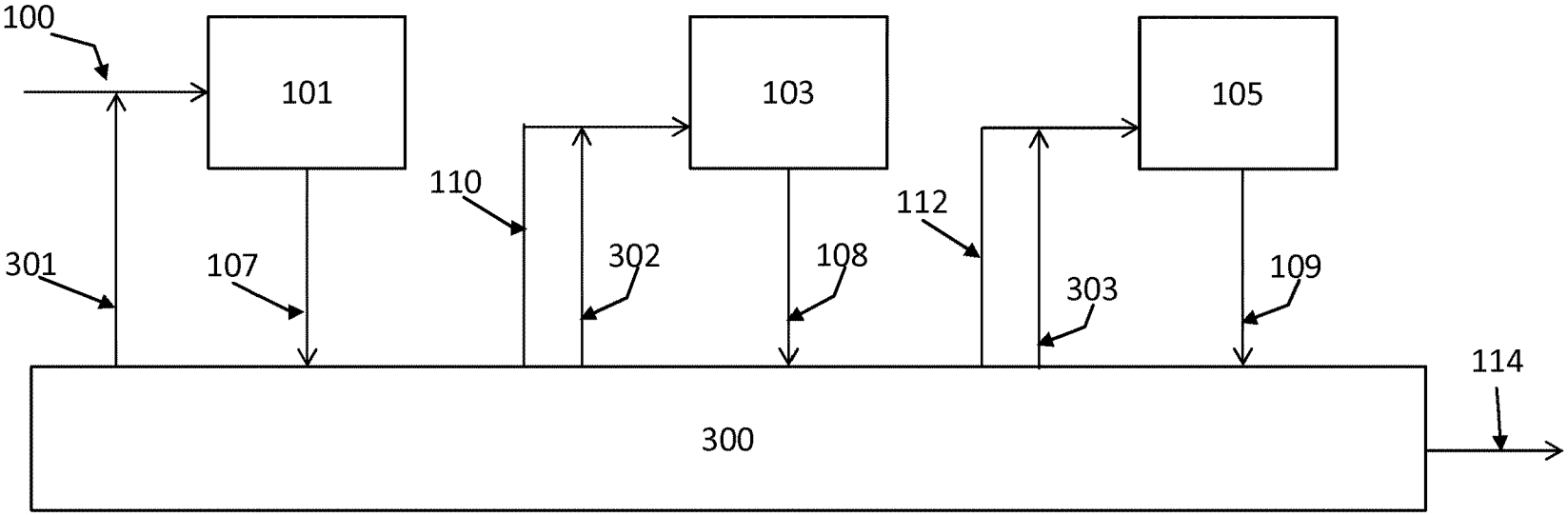

(51) Int. Cl.
*C10G 65/18* (2006.01)
*C10G 65/00* (2006.01)

(52) U.S. Cl.
CPC . *C10G 2300/1048* (2013.01); *C10G 2400/20* (2013.01); *C10G 2400/26* (2013.01); *C10G 2400/28* (2013.01)

(58) Field of Classification Search
USPC ..... 208/59
See application file for complete search history.

(56) References Cited

U.S. PATENT DOCUMENTS

| | | | | |
|---|---|---|---|---|
| 3,409,538 | A * | 11/1968 | Gleim | C10G 65/00 208/108 |
| 3,579,434 | A | 5/1971 | Smith et al. | |
| 3,655,551 | A * | 4/1972 | Hass | C10G 47/18 208/111.15 |
| 3,718,575 | A * | 2/1973 | Watkins | C10G 65/10 208/103 |
| 3,891,539 | A * | 6/1975 | Nelson | C10G 47/12 208/59 |
| 3,928,174 | A | 12/1975 | Bonacci et al. | |
| 3,944,481 | A | 3/1976 | Wing et al. | |
| 4,061,690 | A | 12/1977 | Bernard et al. | |
| 4,137,147 | A * | 1/1979 | Franck | B01J 29/20 208/61 |
| 4,140,621 | A | 2/1979 | Franck et al. | |
| 4,789,457 | A | 12/1988 | Fischer et al. | |
| 6,379,533 | B1 | 4/2002 | Thakkar et al. | |

FOREIGN PATENT DOCUMENTS

| | | | |
|---|---|---|---|
| GB | 1221275 | | 2/1971 |
| WO | 0244306 | A1 | 6/2002 |
| WO | 2007055488 | A1 | 5/2007 |
| WO | 2012071137 | A1 | 5/2012 |
| WO | 2016102248 | A1 | 6/2016 |

OTHER PUBLICATIONS

Alfke et al., "Oil Refining", Ullmann's Encyclopedia of Industrial Chemistry, 2007, 55 pages.
Baerlocher et al.; "Atlas of Zeolite Framework Types"; Elsevier, Fifth Revised Edition, 2001, pp. 1-308.
Heck, R.H. et al., "Hydrocracking of n-butane and n-heptane over a sulfide nickel erionite catalyst", Applied Catalysis A: General 1992, vol. 86, pp. 83-99.
International Search Report for International Application No. PCT/EP2015/079828; dated Aug. 31, 2016; 4 pages.
IUPAC, Compendium of Chemical Terminology, Gold Book, 1997, 2nd edition, 1670 pages.
Scherzer et al., Hydrocracking Science and Technology, 1996, pp. 13-14 and 174.
Speight, J.G., "Petroleum Refinery Process", Kirk-Othmer Encyclopedia of Chemical Technology, 2005, 49 pages.
Written Opinion of the International Search Report for International Application No. PCT/EP2015/079828; dated Aug. 31, 2016; 7 pages.

* cited by examiner

PROCESS FOR PRODUCING C2 AND C3 HYDROCARBONS

CROSS REFERENCE TO RELATED APPLICATIONS

This application is a national phase under 35 U.S.C. § 371 of International Application No. PCT/EP2015/079828, filed Dec. 15, 2015, which claims the benefit of priority to European Patent Application No. 14199591.0 filed Dec. 22, 2014, the entire contents of each of which are incorporated herein by reference in their entirety.

The invention is directed to a process for producing C2 and C3 hydrocarbons from a mixed hydrocarbon feedstream comprising a middle distillate and a system for performing such process.

It is known that liquid petroleum gas (LPG) can be produced by converting naphtha or middle distillates or like materials by cracking, such as hydrocracking. Known processes to convert naphtha or middle distillates or like material to LPG all suffer from either producing an LPG quality that has an undesirably high ratio of C4 hydrocarbons (hereinafter C# hydrocarbons are sometimes referred as C#, wherein # is a positive integer) to C3 hydrocarbons or an excessive production of methane. The undesirably high ratio of C4 hydrocarbons to C3 hydrocarbons results in an unbalance in the volumes of C3 and C4 derivatives/products obtained compared to petrochemical demand. The excessive production of methane is caused when the severity of the hydrocracking is increased to shift the products slate to ethane and propane as desired products.

In the prior art, such as in published patent applications WO2012/071137 and GB1148967, focus has been on maximizing C2. This results in high methane production as well. Alternatively, published US patents numbers U.S. Pat. Nos. 6,379,533, 3,718,575, 3,579,434 and others focus on LPG production including C4. This LPG does not constitute a desired feed for steam cracking for producing particularly useful products such as ethylene and propylene.

For application of LPG as fuel, the C3/C4 ratio is not very relevant, explaining the limited amount of development in this area. WO2012/071137 and GB1148967 describe recycling of C4+ material to maximize ethane production. To limit the size of the recycle stream, this implies a rather high severity in the (single) hydrocracking reactor provided, resulting in excessive methane production. Furthermore, WO2012/071137 and GB1148967 describe no equivalent of a hydrocracking process which results in benzene, toluene, xylene (BTX) product.

Among others, U.S. Pat. Nos. 6,379,533 and 3,718,575 describe a (integrated) multi-stage hydrocracking approach but solely aim at producing LPG with no control over the C3 to C4 ratio or the total amount of C4's being produced. As indicated above, this is a problem when not producing LPG fuels but petrochemicals derived from the C3 and C4 contained in the LPG.

With the demand for C4 derivatives possibly being smaller than for C3 derivatives, it would be desirable to control the amount of C4 produced. It is further desirable to control the composition of the C4 product (normal versus iso-butanes) as this will determine the ratio between the different C4 derivatives that will be produced.

There is a need in the industry for a process for producing C2 and C3 hydrocarbons with a relatively high yield.

Accordingly, the invention provides a process for producing C2 and C3 hydrocarbons, comprising a) subjecting a mixed hydrocarbon stream comprising a middle distillate to first hydrocracking in the presence of a first hydrocracking catalyst to produce a first hydrocracking product stream, b) subjecting a second hydrocracking feed stream to second hydrocracking in the presence of a second hydrocracking catalyst to produce a second hydrocracking product stream, wherein the second hydrocracking is more severe than the first hydrocracking and c) subjecting a C4 hydrocracking feed stream to C4 hydrocracking optimized for converting C4 hydrocarbons into C3 hydrocarbons in the presence of a C4 hydrocracking catalyst to obtain a C4 hydrocracking product stream, wherein the C4 hydrocracking is more severe than the second hydrocracking, wherein the first hydrocracking product stream, the second hydrocracking product stream and the C4 hydrocracking product stream are fed to a separation system which provides

- the second hydrocracking feed stream separated from the first hydrocracking product stream,
- the C4 hydrocracking feed stream separated from the second hydrocracking product stream,
- a first recycle stream to be recycled back to the first hydrocracking,
- a second recycle stream to be recycled back to the second hydrocracking,
- a third recycle stream to be recycled back to the C4 hydrocracking,
- a hydrogen recycle stream of H2 or H2 and C1 hydrocarbon to be recycled back to the first hydrocracking, the second hydrocracking and/or the C4 hydrocracking and
- a C2 and C3 product stream of C3− hydrocarbons, wherein the second hydrocracking feed stream is a stream of C12− hydrocarbons excluding C10-C12 hydrocarbons having di-ring structures, wherein the first recycle stream is a stream of C13+ and C10-C12 hydrocarbons having di-ring structures, wherein the C4 hydrocracking feed stream is a stream of C5−, C4− or iC4− hydrocarbons, wherein the second recycle stream is a stream of C6+, C5+ or nC4+ hydrocarbons and wherein the third recycle stream is a stream of nC4+ or C4+ hydrocarbons.

The product streams from the hydrocracking are fed to a separation system which provides various streams to be fed to different hydrocracking units and the desired final product stream of C3− hydrocarbons. The various recycle streams may be obtained from any of the hydrocracking product streams fed to the separation system.

Preferably, the process of the invention comprises a) subjecting a mixed hydrocarbon stream comprising a middle distillate to first hydrocracking in the presence of a first hydrocracking catalyst to produce a first hydrocracking product stream, a1) subjecting the first hydrocracking product stream to one or more separation steps to obtain

- the second hydrocracking feed stream of C12− hydrocarbons excluding C10-C12 hydrocarbons having di-ring structures and a heavy first hydrocracking product stream of C13+ and C10-C12 hydrocarbons having di-ring structures, a2) recycling at least part of the heavy first hydrocracking product stream to step a), b) subjecting a second hydrocracking feed stream to second hydrocracking in the presence of a second hydrocracking catalyst to produce a second hydrocracking product stream, wherein the second hydrocracking is more severe than the first hydrocracking, b1) subjecting the second hydrocracking product stream to one or more separation steps to obtain the C4 hydrocracking feed stream of C5− hydrocarbons and a heavy second hydrocracking product stream of C6+ hydrocarbons, the C4 hydrocracking feed stream of C4− hydrocarbons and a heavy second hydrocracking product stream of C5+ hydrocarbons or the C4 hydrocracking feed stream of iC4− hydrocarbons and a heavy second hydrocracking product stream of nC4+ hydrocarbons b2) recycling at least part of the heavy second hydrocracking product stream to step b), c) subjecting a C4 hydrocracking feed stream to C4 hydrocracking optimized for converting C4 hydrocarbons into C3 hydrocarbons in the presence of a C4 hydrocracking catalyst to obtain a C4 hydrocracking product stream, wherein the C4 hydrocracking is more severe than the second hydrocracking, c1) subjecting the C4 hydrocracking product stream to one or more separation steps to obtain a light C4 hydrocracking product stream of iC4− hydrocarbons and a heavy C4 hydrocracking product stream of nC4+ hydrocarbons or a light C4 hydrocracking product stream of C3− hydrocarbons and a heavy C4 hydrocracking product stream of C4+ hydrocarbons and c2) recycling at least part of the heavy C4 hydrocracking product stream to step c).

According to the process of the invention, C2-C3 hydrocarbons are produced from a middle distillate by successive hydrocracking. The conditions of the successive hydrocracking steps are selected such that the subsequent hydrocracking step is more severe (i.e. more lower hydrocarbons are formed) than the previous hydrocracking steps. After each step of hydrocracking, the hydrocracking product stream is subjected to one or more separation steps. Separations are performed to obtain a light portion to be subjected to the subsequent, more severe hydrocracking and a heavy portion of the product stream to be recycled back. H2 or H2 and C1 may be separated from the product streams to be recycled back. This successive hydrocracking allows hydrocracking of different hydrocarbons at different conditions optimized for maximizing the ultimate yield of C2-C3 hydrocarbons while reducing the yield of C1 hydrocarbon.

U.S. Pat. No. 3,928,174 discloses processing of reformate product of catalytic reforming. In the method of U.S. Pat. No. 3,928,174, C5+ reformate is separated into C5− and C6+ in a first separation zone. The C6+ is further separated into a first fraction comprising some C7 and lower boiling paraffin and aromatic components and a second fraction comprising C7 and higher boiling paraffin and aromatic components. The first fraction is passed in contact with a first zeolite catalyst for cracking paraffins to form LPG and redistribute the benzene/toluene ratio. The product is separated into C2− and C3+. C3+ is recycled to the first separation zone. A portion of the second fraction is passed in contact with a second zeolite catalyst for cracking paraffins and disproportionating aromatics to form BTX. The product is separated into a hydrogen rich stream, a BTX rich stream and an intermediate product stream lower boiling than the BTX rich stream. The intermediate product stream is recycled to the first separation zone.

U.S. Pat. No. 3,928,174 does not mention the idea of successive hydrocracking in which the light portion of the product stream is fed to the subsequent, more severe hydrocracking and the heavy portion of the product stream is recycled back. In the method of U.S. Pat. No. 3,928,174, no mention is made on the C4 hydrocracking feed stream separated from the second hydrocracking product stream as required in the process of the invention, among others. According to the process of the invention, the forming of the C4 hydrocracking feed stream involves first hydrocracking, separating out the lighter portion of the first hydrocracking product, second hydrocracking said lighter portion and separating out the lighter portion of the second hydrocracking product. Such successive steps are not mentioned in U.S. Pat. No. 3,928,174.

The first hydrocracking under relatively mild conditions (i.e. conditions which do not produce a large amount of lighter hydrocarbons) results mainly in hydrocracking of the relatively heavy hydrocarbons. The first hydrocracking product stream obtained comprises H2 and a range of hydrocarbons, including C13+ hydrocarbons and C10-C12 hydrocarbons having di-ring structures. C13+ hydrocarbons and C10-C12 hydrocarbons having di-ring structures in the first hydrocracking product stream is separated and recycled back to the first hydrocracking (first recycle stream). The lighter portion is subjected to second hydrocracking more severe than the first hydrocracking. The portion to be subjected to the second hydrocracking may be the whole of the lighter portion (H2 and C1-C12 excluding C10-C12 hydrocarbons having di-ring structures) or part of the lighter portion (e.g. C1-C12, C2-C12, C4-C12 or C5-C12 excluding C10-C12 hydrocarbons having di-ring structures), as described later.

The second hydrocracking results in a stream rich in LPG, but the product stream further comprises C5+ hydrocarbons. The heavier portion such as C5+ hydrocarbons in the second hydrocracking product stream is separated and recycled back to the second hydrocracking. The lighter portion is subjected to C4 hydrocracking optimized for converting C4 hydrocarbons to C3 hydrocarbons. The portion to be subjected to the C4 hydrocracking may be the whole of the lighter portion (e.g. H2 and C1-C4) or part of the lighter portion (e.g. C1-C4, C2-C4 or only C4), as described later.

The C4 hydrocracking results in a stream rich in C2 and C3, but further comprises unconverted C4 hydrocarbons and possibly newly made C5+ hydrocarbons. The C4+ hydrocarbons in the C4 hydrocracking product stream is separated and recycled back to the C4 hydrocracking. In case the C4 hydrocracking product stream comprises heavier hydrocarbons such as C6+, only C4-C5 hydrocarbons of the C4 hydrocracking product stream may be recycled back to the C4 hydrocracking. The lighter portion comprises C2 and C3, which are the desired products.

DEFINITIONS

The term "alkane" or "alkanes" is used herein having its established meaning and accordingly describes acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes") and branched alkanes ("iso-paraffins" or "iso-alkanes") but excludes naphthenes (cycloalkanes).

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekulé structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly describes saturated cyclic hydrocarbons.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG as used herein generally consists of a blend of C2-C4 hydrocarbons i.e. a mixture of C2, C3, and C4 hydrocarbons.

One of the petrochemical products which may be produced in the process of the present invention is BTX. The term "BTX" as used herein relates to a mixture of benzene, toluene and xylenes. Preferably, the product produced in the process of the present invention comprises further useful aromatic hydrocarbons such as ethylbenzene. Accordingly, the present invention preferably provides a process for producing a mixture of benzene, toluene xylenes and ethylbenzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethylbenzene product stream.

As used herein, the term "C# hydrocarbons", wherein "#" is a positive integer, is meant to describe all hydrocarbons having # carbon atoms. C# hydrocarbons are sometimes indicated as just "C#". Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

As used herein, the term "a stream of C#−hydrocarbons" is understood to mean that said stream is formed by a separation which removes hydrocarbons having more number of carbons than #. The term "a stream of C#+ hydrocarbons" is understood to mean that said stream is formed by a separation which removes hydrocarbons having less number of carbons than #. The term "a stream of C#1-C#2 hydrocarbons" is understood to mean that said stream is substantially formed by separations which remove hydrocarbons having more number of carbons than #2 and hydrocarbons having less number of carbons than #1.

As used herein, the term "hydrocracker unit" or "hydrocracker" relates to a unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons, and, depending on the reaction conditions such as temperature, pressure and space velocity and catalyst activity, naphthenic (cycloalkane) hydrocarbons aromatic hydrocarbons including BTX. Hydrocracking reactions proceed through a bifunctional mechanism which requires an acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by combining various transition metals, or metal sulfides with the solid support such as alumina, silica, alumina-silica, magnesia and zeolites. The catalysts may be a physical mixture of two catalysts with different metals or supports. Hydrocracking reactions can also proceed via the so-called mono-molecular or Haag-Dessau cracking mechanism which only requires the presence of acid sites. This is usually important at higher temperatures (i.e. >500° C.) but can also play a role at lower temperatures.

Step a)

A mixed hydrocarbon stream is subjected to the first hydrocracking in step a). Part of the hydrocarbon stream produced in the process of the invention (first recycle stream such as heavy first hydrocracking product stream) is recycled back to be subjected to the first hydrocracking of step a), as described later. The mixed hydrocarbon stream and the first recycle stream may be combined before being fed to the first hydrocracking unit or the mixed hydrocarbon stream and the recycled hydrocarbon stream may be fed to the first hydrocracking unit at different inlets.

First Hydrocracking

The first hydrocracking is a hydrocracking processing suitable for hydrocracking middle-distillate, hereinafter sometimes referred as middle-distillate hydrocracking.

The mixed hydrocarbon stream subjected to the first hydrocracking comprises a middle distillate. The terms light-distillate, middle-distillate and heavy-distillate are used herein having their generally accepted meaning in the field of petroleum refinery processes; see Speight, J. G. (2005) loc.cit. The middle distillate typically has a boiling point range of about 180-360° C.

The term "middle-distillate" is meant to include medium hydrocarbon fractions derived from a refinery-unit such as hydrocracking, catalytic cracking, thermal cracking, coking, Fischer-Tropsch process etc, or fractions derived by separations from crude oil, crude petroleum, shale oil and the like. The mixed hydrocarbon stream to be subjected to step a) can be pretreated before hydrocracking, for example by desulfurization or denitrogenation. The mixed hydrocarbon stream to be subjected to step a) may also result from previous hydrocracking such as resid hydocracking, e.g. slurry hydrocracking.

Preferably, a refinery-unit derived middle-distillate is the hydrocarbon distillate obtained in a refinery unit process having a boiling point range of about 180-360° C., more preferably of about 190-350° C. The "middle-distillate" is relatively rich in aromatic hydrocarbons having two aromatic rings.

The middle-distillate obtained by crude oil distillation includes "kerosene" and "gasoil". The terms kerosene and gasoil are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. Preferably, the term "kerosene" as used herein relates to the petroleum fraction obtained by crude oil distillation having a boiling point range of about 180-270°

C., more preferably of about 190-260° C. Preferably, the term "gasoil" as used herein relates to the petroleum fraction obtained by crude oil distillation having a boiling point range of about 250-360° C., more preferably of about 260-350° C.

The first hydrocracking is a catalytic cracking process assisted by the presence of an elevated partial pressure of hydrogen using a feed having a boiling point range of a middle-distillate; see e.g. see Alfke et al. (2007) Oil Refining, Ullmann's Encyclopedia of Industrial Chemistry.

Accordingly, middle-distillate hydrocracking is a specific hydrocracking process that is particularly suitable for converting a feed that is relatively rich in aromatic hydrocarbon having a boiling point in the kerosene and gasoil boiling point range, and optionally the vacuum gasoil boiling point range, to produce LPG and, depending on the specific process and/or process conditions, a light-distillate (middle-distillate hydrocracking-derived gasoline). Such a middle-distillate hydrocracking process is for instance described in U.S. Pat. Nos. 3,256,176 and 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt -% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the middle-distillate hydrocracking process produces a light-distillate ("middle-distillate hydrocracking-gasoline") which is relatively rich in hydrocarbon compounds having one aromatic and or naphthenic ring. In the context of the present invention, it is preferred to use an middle-distillate hydrocracking process that is optimized to keep one aromatic or naphthenic ring intact and thus to produce a light-distillate which is relatively rich in hydrocarbon compounds having one aromatic or naphthenic ring.

As described elsewhere, the first hydrocracking is relatively mild and does not result in a high amount of methane. Preferably, the amount of methane in the first hydrocracking product stream is at most 5 wt %, Step a1)

The first hydrocracking product stream comprises H2 and C1-12 and C13+ hydrocarbons. The C10-C12 hydrocarbons include C10-C12 hydrocarbons having di-ring structures, such as naphthalene.

The first hydrocracking product stream is subjected to one or more separation steps to separate between C12− hydrocarbons excluding C10-C12 hydrocarbons having di-ring structures and C13+ and C10-C12 hydrocarbons having di-ring structures. This separation provides a heavy first hydrocracking product stream of C13+ and C10-C12 hydrocarbons having di-ring structures.

Preferably, all of the heavy first hydrocracking product stream is recycled back to step a). However, the heavy first hydrocracking product stream may be subjected to one or more further separations and only part of the heavy first hydrocracking product stream may be recycled back to step a). This forms the first recycle stream.

A second hydrocracking feed stream substantially free of C13+ hydrocarbons and C10-C12 hydrocarbons having di-ring structures is obtained from the first hydrocracking product stream.

In some embodiments, all of the first hydrocracking product stream minus the heavy first hydrocracking product stream, i.e. H2 and C1-C12 hydrocarbons excluding C10-C12 hydrocarbons having di-ring structures, may form the second hydrocracking feed stream. In other embodiments, further separations may be performed such that only a part of the first hydrocracking product stream minus the heavy first hydrocracking product stream forms the second hydrocracking feed stream.

In some preferred embodiments, step a1) includes a separation between C4 and C5 to obtain a stream of C4− and a stream of C5-C12 hydrocarbons excluding C10-C12 hydrocarbons having di-ring structures. In these cases, the second hydrocracking feed stream consists of C5-C12 hydrocarbons excluding C10-C12 hydrocarbons having di-ring structures and does not include C4− hydrocarbons. Preferably, the stream of C4− so obtained is subjected to the C4 hydrocracking of step c). In these advantageous embodiments, the first hydrocracking product stream is separated into different streams of hydrocarbons which are each subjected to optimal hydrocracking, i.e. a stream of C4− to be subjected to the C4 hydrocracking optimized for C4 to C3 conversion, a stream of C5-C12 excluding C10-C12 hydrocarbons having di-ring structures to be subjected to the second hydrocracking optimized for LPG production and a stream of C13+ and C10-C12 hydrocarbons having di-ring structures stream to be subjected to the mild first hydrocracking.

In some preferred embodiments, step a1) includes a separation between C3 and C4 to obtain a stream of C3− and a stream of C4-C12 hydrocarbons excluding C10-C12 hydrocarbons having di-ring structures. In these cases, the second hydrocracking feed stream consists of C4-C12 hydrocarbons excluding C10-C12 hydrocarbons having di-ring structures and does not include C3− hydrocarbons. Preferably, the stream of C3− hydrocarbons so obtained is used as a final product or subjected to further separations and conversions. In these advantageous embodiments, the first hydrocracking product stream is separated into a stream of C3-hydrocarbons which does not require a further hydrocracking, a stream of C4-C12 excluding C10-C12 hydrocarbons having di-ring structures to be subjected to the second hydrocracking optimized for LPG production and a stream of C13+ and C10-C12 hydrocarbons having di-ring structures stream to be subjected to the mild first hydrocracking.

In some preferred embodiments, step a1) includes a separation between C3 and C4 and C4 and C5 to obtain a stream of C3−, a stream of C4 and a stream of C5-C12 hydrocarbons excluding C10-C12 hydrocarbons having di-ring structures. In these cases, the second hydrocracking feed stream consists of C5-C12 hydrocarbons excluding C10-C12 hydrocarbons having di-ring structures and does not include C4 or C3− hydrocarbons. Preferably, the stream of C4 so obtained is subjected to the C4 hydrocracking of step c). Preferably, the stream of C3−hydrocarbons so obtained is used as a final product or subjected to further separations and conversions. In these advantageous embodiments, the first hydrocracking product stream is separated into a stream of C3− hydrocarbons which does not require a further hydrocracking, a stream of C4 to be subjected to the C4 hydrocracking optimized for C4 to C3 conversion, a stream of C5-C12 excluding C10-C12 hydrocarbons having di-ring structures to be subjected to the second hydrocracking optimized for LPG production and a stream of C13+ and C10-C12 hydrocarbons having di-ring structures stream to be subjected to the mild first hydrocracking.

In some preferred embodiments, step a1) includes separating H2 or H2 and C1 from the first hydrocracking product stream to be recycled back to step a). This separation may be performed in addition to the separation between C12 and C13, between C4 and C5 and/or between C3 and C4.

Step a2)

At least part of the heavy first hydrocracking product stream obtained from the first hydrocracking product stream is recycled back to step a). This recycled part forms the first recycle stream.

Step b)

The second hydrocracking feed stream obtained from the first hydrocracking product stream is subjected to the second hydrocracking in step b). The second hydrocracking feed stream is substantially free of C13+ hydrocarbons and C10-C12 hydrocarbons having di-ring structures. Part of the hydrocarbon stream produced in the process of the invention (second recycle stream such as heavy second hydrocracking product stream) is recycled back to be subjected to the second hydrocracking of step b), as described later. The second hydrocarbon feed stream and the second recycle stream may be combined before being fed to the second hydrocracking unit or the mixed hydrocarbon stream and the recycled hydrocarbon stream may be fed to the second hydrocracking unit at different inlets.

The second hydrocracking is more severe than the first cracking in the process of the present invention. A severe hydrocracking is herein meant that more cracking of the lighter or shorter hydrocarbons (e.g. C4 hydrocarbon) occurs. The feature 'the second hydrocracking is more severe than the first hydrocracking' is herein understood to mean that the catalyst and the conditions (temperature, pressure and WHSV) of the second hydrocracking are chosen such that the stream produced by the second hydrocracking comprises a higher proportion of C1-C3 than the stream produced by the first hydrocracking for a given hydrocarbon feed stream. For example, the second hydrocracking may be performed at a higher temperature and/or a lower WHSV and/or using a hydrocracking catalyst with a higher hydrocracking ability.

Second Hydrocracking

The second hydrocracking is a hydrocracking process suitable for converting a complex hydrocarbon feed that is relatively rich in naphthenic and paraffinic hydrocarbon compounds to a product stream rich in LPG and aromatic hydrocarbons. Such hydrocracking is described e.g. in U.S. Pat. No. 3,718,575, GB1148967 and U.S. Pat. No. 6,379,533. Preferably, the amount of the LPG in the second hydrocracking product stream is at least 50 wt %, more preferably at least 60 wt %, more preferably at least 70 wt % and more preferably at least 80 wt % of the total second hydrocracking product stream. Preferably, the amount of the C2-C3 in the second hydrocracking product stream is at least 40 wt %, more preferably at least 50 wt %, more preferably at least 60 wt % and more preferably at least 65 wt % of the total second hydrocracking product stream. Preferably, the amount of the aromatic hydrocarbons in the second hydrocracking product stream is 3-20 wt %, e.g. 5-15 wt %. Although more severe than the first hydrocracking, the second hydrocracking is still relatively mild and does not result in a high amount of methane. Preferably, the amount of methane in the second hydrocracking product stream is at most 5 wt %, The second hydrocracking catalyst may be a conventional catalyst generally used for hydrocracking of a mixture of hydrocarbons. For example, the second hydrocracking catalyst may be a catalyst containing one metal or two or more associated metals of group VIII, VI B or VII B of the periodic classification of elements, deposited on a carrier of sufficient surface and volume, such as, for example, alumina, silica, alumina-silica, zeolite, etc; when using a zeolite, the metal (s) may be introduced by appropriate exchange. The metals are, for example, palladium, iridium, tungsten, rhenium, cobalt, nickel, etc. used alone or as mixtures. The metal concentrations may be preferably 0.1 to 10 wt %.

Preferably, the conditions for the second hydrocracking include a temperature of 250-580° C., more preferably 300-450° C., a pressure of 300-5000 kPa gauge, more preferably 1200-4000 kPa gauge and a WHSV of 0.1-15 $h^{-1}$, more preferably 1-6 $h^{-1}$. Preferably, the molar ratio of hydrogen to hydrocarbon species (H2/HC molar ratio) is 1:1-4:1, more preferably 1:1-2:1.

Second Hydrocracking Product Stream

By step b), the proportion of LPG (C2-C4 hydrocarbons) is increased compared to the feed stream. The second hydrocracking product stream obtained by step b) comprises H2 and C1, LPG (C2-C4 hydrocarbons), C5 and C6+ hydrocarbons. The C4 hydrocarbons includes normal C4 hydrocarbons (herein sometimes referred as nC4 hydrocarbons) such as n-butane and iso C4 hydrocarbons (herein sometimes referred as iC4 hydrocarbons) such as isobutane.

Step b1)

The second hydrocracking product stream is subjected to one or more separation steps to obtain the C4 hydrocracking feed stream and the heavy second hydrocracking product stream The separation for obtaining the C4 hydrocracking feed stream and the heavy second hydrocracking product may be performed at various points: between C5 and C6, C4 and C5 (i.e. nC4 and C5) or iC4 and nC4. The separations respectively provides

- the C4 hydrocracking feed stream of C5− hydrocarbons and a heavy second hydrocracking product stream of C6+ hydrocarbons,
- the C4 hydrocracking feed stream of C4− hydrocarbons and a heavy second hydrocracking product stream of C5+ hydrocarbons or
- the C4 hydrocracking feed stream of iC4− hydrocarbons and a heavy second hydrocracking product stream of nC4+ hydrocarbons.

Preferably, all of the heavy second hydrocracking product stream is recycled back to step b). However, the heavy second hydrocracking product stream may be subjected to one or more further separations and only part of the heavy second hydrocracking product stream may be recycled back to step b). This forms the second recycle stream.

A C4 hydrocracking feed stream is obtained from the lighter portion of the second hydrocracking product stream. In some embodiments, all of the second hydrocracking product stream minus the heavy second hydrocracking product stream may form the C4 hydrocracking feed stream. In other embodiments, further separations may be performed such that only a part of the second hydrocracking product stream minus the heavy second hydrocracking product stream forms the C4 hydrocracking feed stream.

In some preferred embodiments, step b1) includes a separation between C3 and C4 to obtain a stream of C3− hydrocarbons and a stream of C4 hydrocarbons. In these cases, the C4 hydrocracking feed stream consists of C4 hydrocarbons and does not include C3-hydrocarbons. Preferably, the stream of C3− so obtained is used as a final product or subjected to further separations and conversions.

In some preferred embodiments, step b1) includes separating H2 or H2 and C1 from the second hydrocracking product stream to be recycled back to step b). This separation may be performed in addition to the separations mentioned above.

Step b2)

At least part of the heavy second hydrocracking product stream obtained from the second hydrocracking product stream is recycled back to step b). This recycled part forms the second recycle stream.

Additional Step

In some embodiments, part of the heavy second hydrocracking product stream obtained from the second hydrocracking product stream is subjected to a further hydrocracking more severe than the second hydrocracking and less severe than the C4 hydrocracking for the production of BTX.

Accordingly, in some embodiments, the process further comprises the step of subjecting a part of the heavy second hydrocracking product stream to third hydrocracking cracking in the presence of a third hydrocracking catalyst to produce a third hydrocracking product stream comprising BTX and which is substantially free from non-aromatic C6+ hydrocarbons, wherein the third hydrocracking is more severe than the second hydrocracking and less severe than the C4 hydrocracking.

This is advantageous in that part of the heavy second hydrocracking product stream is subjected to hydrocracking optimized for producing pure BTX.

The part of the heavy second hydrocarbon product stream to be subjected to the third hydrocracking preferably is C6+, but may also include C5 and/or nC4. More preferably, C5 of the heavy second hydrocracking product stream is recycled back to step b) and C6+ of the heavy second hydrocracking product stream is subjected to the third hydrocracking.

The third hydrocracking process is a hydrocracking process suitable for converting a complex hydrocarbon feed that is relatively rich in aromatic hydrocarbon compounds with one ring to LPG and BTX, wherein said process is optimized to keep the aromatic ring intact of the aromatics comprised in the feedstream, but to remove most of the longer side-chains from said aromatic ring. A significant portion of 6-ring naphthenes can be converted to aromatics. Substantially all co-boilers of aromatic C6+ hydrocarbons are hydrocracked. The second hydrocracking product stream is hence preferably substantially free from non-aromatic C6+ hydrocarbons. As meant herein, the term "stream substantially free from non-aromatic C6+ hydrocarbons" means that said stream comprises less than 1 wt-% non-aromatic C6+ hydrocarbons, preferably less than 0.7 wt-% non-aromatic C6+ hydrocarbons, more preferably less than 0.6 wt-% non-aromatic C6+ hydrocarbons and most preferably less than 0.5 wt-% non-aromatic C6+ hydrocarbons.

In the third hydrocracking in the process according to the invention, the heavy hydrocarbon stream is contacted in the presence of hydrogen with a third hydrocracking catalyst.

Catalysts having hydrocracking activity are described on pages 13-14 and 174 of Hydrocracking Science and Technology (1996) Ed. Julius Scherzer, A. J. Gruia, Pub. Taylor and Francis. Hydrocracking reactions generally proceed through a bifunctional mechanism which requires a relatively strong acid function, which provides for the cracking and isomerization and a metal function, which provides for the olefin hydrogenation. Many catalysts used for the hydrocracking process are formed by composting various transition metals with the solid support such as alumina, silica, alumina-silica, magnesia and zeolites.

In preferred embodiments of the invention, the third hydrocracking catalyst is a hydrocracking catalyst comprising 0.01-1 wt-% hydrogenation metal in relation to the total catalyst weight and a zeolite having a pore size of 5-8 Å and a silica ($SiO_2$) to alumina ($Al_2O_3$) molar ratio of 5-200.

The process conditions comprise a temperature of 300-580° C., a pressure of 300-5000 kPa gauge and a Weight Hourly Space Velocity of 0.1-15 $h^{-1}$.

Preferably, the catalyst is a hydrocracking catalyst comprising 0.01-1 wt-% hydrogenation metal in relation to the total catalyst weight and a zeolite having a pore size of 5-8 Å and a silica ($SiO_2$) to alumina ($Al_2O_3$) molar ratio of 5-200 and the process conditions comprise a temperature of 425-580° C., a pressure of 300-5000 kPa gauge and a Weight Hourly Space Velocity of 0.1-15 $h^{-1}$. In these embodiments, the obtained third hydrocracking product stream is advantageously substantially free from non-aromatic C6+ hydrocarbons due to the catalyst and the conditions employed. Hence, chemical grade BTX can easily be separated from the hydrocracking product stream.

Preferably, the third hydrocracking is performed at a temperature of 425-580° C., more preferably 450-550° C.

Preferably, the third hydrocracking is performed at a pressure of 300-5000 kPa gauge, more preferably at a pressure of 1200-4000 kPa gauge. By increasing reactor pressure, conversion of C6+ non-aromatics can be increased, but also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1200-1600 kPa.

Preferably, the third hydrocracking step is performed at a Weight Hourly Space Velocity (WHSV) of 0.1-15 $h^{-1}$, more preferably at a Weight Hourly Space Velocity of 1-6 $h^{-1}$. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Accordingly, preferred conditions for the third hydrocracking step thus include a temperature of 425-580° C., a pressure of 300-5000 kPa gauge and a Weight Hourly Space Velocity of 0.1-15 $h^{-1}$. More preferred hydrocracking conditions include a temperature of 450-550° C., a pressure of 1200-4000 kPa gauge and a Weight Hourly Space Velocity of 1-6 $h^{-1}$.

Preferably, the molar ratio of hydrogen to hydrocarbon species (H2/HC molar ratio) is 1:1-4:1, more preferably 1:1-2:1.

Hydrocracking catalysts that are particularly suitable for the process of the present invention comprise a molecular sieve, preferably a zeolite, having a pore size of 5-8 Å.

Zeolites are well-known molecular sieves having a well-defined pore size. As used herein, the term "zeolite" or "aluminosilicate zeolite" relates to an aluminosilicate molecular sieve. An overview of their characteristics is for example provided by the chapter on Molecular Sieves in Kirk-Othmer Encyclopedia of Chemical Technology, Volume 16, p 811-853; in Atlas of Zeolite Framework Types, 5th edition, (Elsevier, 2001). Preferably, the hydrocracking catalyst comprises a medium pore size aluminosilicate zeolite or a large pore size aluminosilicate zeolite. Suitable zeolites include, but are not limited to, ZSM-5, MCM-22, ZSM-11, beta zeolite, EU-1 zeolite, zeolite Y, faujastite, ferrierite and mordenite. The term "medium pore zeolite" is commonly used in the field of zeolite catalysts. Accordingly, a medium pore size zeolite is a zeolite having a pore size of about 5-6 Å. Suitable medium pore size zeolites are 10-ring zeolites, i.e. the pore is formed by a ring consisting of 10 $SiO_4$ tetrahedra. Suitable large pore size zeolites have a pore size of about 6-8 Å and are of the 12-ring structure type. Zeolites of the 8-ring structure type are called small pore size zeolites. In the above cited Atlas of Zeolite Framework Types various zeolites are listed based on ring structure. Most preferably the zeolite is ZSM-5 zeolite, which is a well-known zeolite having MFI structure.

Preferably, the silica to alimuna ratio of the ZSM-5 zeolite is in the range of 20-200, more preferably in the range of 30-100.

The zeolite is in the hydrogen form: i.e. having at least a portion of the original cations associated therewith replaced by hydrogen. Methods to convert an aluminosilicate zeolite to the hydrogen form are well known in the art. A first method involves direct ion exchange employing an acid and/or salt. A second method involves base-exchange using ammonium salts followed by calcination.

Furthermore, the catalyst composition comprises a sufficient amount of hydrogenation metal to ensure that the catalyst has a relatively strong hydrogenation activity. Hydrogenation metals are well known in the art of petrochemical catalysts.

The catalyst composition preferably comprises 0.01-1 wt-% hydrogenation metal, more preferably 0.01-0.7 wt-%, most preferably 0.01-0.5 wt-% hydrogenation metal, more preferably 0.01-0.3 wt-%. The catalyst composition may more preferably comprise 0.01-0.1 wt-% or 0.02-0.09 wt-% hydrogenation metal. In the context of the present invention, the term "wt %" when relating to the metal content as comprised in a catalyst composition relates to the wt % (or "wt-%") of said metal in relation to the weight of the total catalyst, including catalyst binders, fillers, diluents and the like. Preferably, the hydrogenation metal is at least one element selected from Group 10 of the Periodic Table of Elements. The preferred Group 10 element is platinum (Pt). Accordingly, the hydrocracking catalyst used in the process of the present invention comprises a zeolite having a pore size of 5-8 Å, a silica ($SiO_2$) to alumina ($Al_2O_3$) molar ratio of 5-200 and 0.01-1 wt-% platinum (in relation to the total catalyst).

The hydrocracking catalyst composition may further comprise a binder. Alumina ($Al_2O_3$) is a preferred binder. The catalyst composition of the present invention preferably comprises at least 10 wt-%, most preferably at least 20 wt-% binder and preferably comprises up to 40 wt-% binder. In some embodiments, the hydrogenation metal is deposited on the binder, which preferably is $Al_2O_3$.

According to some embodiments of the invention, the hydrocracking catalyst is a mixture of the hydrogenation metal on a support of an amorphous alumina and the zeolite.

According to other embodiments of the invention, the hydrocracking catalyst comprises the hydrogenation metal on a support of the zeolite. In this case, the hydrogenation metal and the zeolite giving cracking functions are in closer proximity to one another which translates into a shorter diffusion length between the two sites. This allows high space velocity, which translates into smaller reactor volumes and thus lower CAPEX. Accordingly, in some preferred embodiments, the hydrocracking catalyst is the hydrogenation metal on a support of the zeolite and the second hydrocracking is performed at a Weight Hourly Space Velocity of 10-15 $h^{-1}$.

The hydrocracking catalyst may be free of further metals or may comprise further metals. In case the hydrocracking catalyst comprises a further element that reduces the hydrogenation activity of the catalyst, such as tin, lead or bismuth, lower temperatures may be selected for the second hydrocracking step; see e.g. WO 02/44306 A1 and WO 2007/055488.

In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

The third hydrocracking step is performed in the presence of an excess amount of hydrogen in the reaction mixture. This means that a more than stoichiometric amount of hydrogen is present in the reaction mixture that is subjected to hydrocracking. Preferably, the molar ratio of hydrogen to hydrocarbon species (H2/HC molar ratio) in the reactor feed is between 1:1 and 4:1, preferably between 1:1 and 3:1 and most preferably between 1:1 and 2:1. A higher benzene purity in the product stream can be obtained by selecting a relatively low $H_2$/HC molar ratio. In this context the term "hydrocarbon species" means all hydrocarbon molecules present in the reactor feed such as benzene, toluene, hexane, cyclohexane etc. It is necessary to know the composition of the feed to then calculate the average molecular weight of this stream to be able to calculate the correct hydrogen feed rate. The excess amount of hydrogen in the reaction mixture suppresses the coke formation which is believed to lead to catalyst deactivation.

Second Hydrocracking

As mentioned above, the second hydrocracking is a hydrocracking process suitable for converting a complex hydrocarbon feed that is relatively rich in naphthenic and paraffinic hydrocarbon compounds to a product stream rich in LPG and aromatic hydrocarbons.

The second hydrocracking may be optimized to keep the aromatic ring intact of the aromatics comprised in the feedstream, but to remove most of the longer side-chains from said aromatic ring. In such a case, the process conditions to be employed for the second hydrocracking step are similar to the process conditions to be used in the third hydrocracking step as described herein above: a temperature of 300-580° C., a pressure of 300-5000 kPa gauge and a Weight Hourly Space Velocity of 0.1-15 $h^{-1}$. In this case, the suitable catalyst used for the second hydrocracking step is the same as the ones described for the third hydrocracking step. For example, the catalyst for the second hydrocracking step is a hydrocracking catalyst comprising 0.01-1 wt-% hydrogenation metal in relation to the total catalyst weight and a zeolite having a pore size of 5-8 Å and a silica ($SiO_2$) to alumina ($Al_2O_3$) molar ratio of 5-200.

The second hydrocracking is however less severe than the third hydrocracking, as described above. Preferably, the second hydrocracking conditions comprise a lower process temperature than the third hydrocracking step. Accordingly, the second hydrocracking step conditions preferably comprise a temperature of 300-450° C., more preferably 300-425° C., more preferably 300-400° C.

Step c)

The C4 hydrocracking feed stream obtained from the second hydrocracking product stream is subjected to the C4 hydrocracking in step c). Part of the hydrocarbon stream produced in the process of the invention (third recycle stream such as heavy C4 hydrocracking product stream) is recycled back to be subjected to the C4 hydrocracking of step c), as described later. The C4 hydrocarbon feed stream and the third recycle stream may be combined before being fed to the C4 hydrocracking unit or the mixed hydrocarbon stream and the recycled hydrocarbon stream may be fed to the C4 hydrocracking unit at different inlets.

C4 Hydrocracking

As used herein, the term "C4 hydrocracking" refers to a hydrocracking process optimized for converting C4 hydrocarbons to C3 hydrocarbons. Such a process is known from, for example U.S. Pat. No. 4,061,690. Due to the high selectivity towards C3, conversion of C3 already present in the feed would not be significant. The degree of conversion of C2 and C1 would be even less. Hence, the C4 hydrocracking product stream will contain a high ratio of C3 to C4.

Preferably, the C4 hydrocracking feed stream substantially consists of C4 and C5 hydrocarbons. Preferably, the amount of the C4 and C5 hydrocarbons in the C4 hydrocracking feed stream is at least 70 wt %, more preferably 80 wt % even more preferably 90 wt %. Preferably, the amount of the C3− hydrocarbons in the C4 hydrocracking feed stream is at most 10 wt %, more preferably 5 wt %. Preferably, the amount of the C6+ hydrocarbons in C4 hydrocracking feed stream is at most 10 wt %, more preferably 5 wt %. The absence of C6+ hydrocarbons in the C4 hydrocracking feed stream allows more C4/C5 to be converted to C2/C3. If non-aromatic C6+ is present in the feed, they are more likely to be converted than C4/C5, which reduces the conversion of C4/C5.

Preferably, the amount of methane in the C4 hydrocracking product stream is at most 15 wt %, more preferably at most 10 wt %, even more preferably at most 7 wt %. Preferably, the amount of the C2-C3 hydrocarbons in the C4 hydrocracking product stream is at least 60 wt %, more preferably 70 wt %, even more preferably at least 80 wt %. Preferably, the amount of the C4+ hydrocarbons in the C4 hydrocracking product stream is at most 30 wt %, more preferably at most 20 wt % and even more preferably at most 15 wt %.

C4 hydrocracking is a catalytic hydrocracking process. The catalyst used preferably comprises zeolites of the mordenite (MOR)-type or of the erionite (ERI)-type.

The chemical composition of mordenite related to one cellular unit can be represented by the formula: $M(8/n)[(AlO_2)_8(SiO_2)_{40}].24H_2O$ wherein M is a cation having a valence n. M is preferably sodium, potassium or calcium.

The chemical composition of erionite can be represented by the formula $$(Na_2,K_2,Ca)_2Al_4Si_{14}O_{36}.15H_2O.$$

As in the case of all zeolites, erionite and mordenite are crystalline silico-aluminate constituted by $SiO_4$ and $AlO_4^-$ tetrahedron groups, the negative charge being compensated by an exchangeable cation. Erionite and mordenite occur in the natural state in the form of a salt of sodium, calcium and/or potassium. Preferably, erionite and mordenite are employed in their acid form by replacing the cation which is present by the hydrogen ion (to form hydrogenated erionite, H-erionite, or hydrogenated mordenite, H-mordenite) or a plurivalent cation. By way of example, this replacement can be achieved by ion exchange with the plurivalent cation or the ammonium ion for the hydrogen form, followed by drying and calcination of the zeolite. The plurivalent cations which endow the erionite or the mordenite with acidity and therefore hydrocracking activity can be the alkaline-earth cations such as beryllium, magnesium, calcium, strontium and barium or else the cations of the rare earths.

Erionite and mordenite can be employed in its hydrogen form by virtue of its higher activity, with a residual proportion of sodium of less than 1% by weight with respect to the dehydrated erionite or mordenite.

The erionite or mordenite can occur in two types, namely the large-pore type and the small pore type. By way of indication, the erionites and mordenites in the form of sodium are capable of sorbing hydrocarbons having a diameter of less than approximately 7 Å in the case of the large-pore type and approximately 5 Å in the case of the small pore type. If the erionite or mordenite is in its hydrogen form, the size of the sorbed molecules can increase to 8-9 Å in the case of the large pore types and 7 Å in the case of the small pore types.

It should be noted that erionite or mordenite are not completely characterized by the formula given above since it can be modified by selective dissolution of alumina by means of suitable solvents such as mineral acids.

Further, a dealuminated or desilicated erionite or mordenite can be employed for C4 hydrocracking. The dealumination or desilication treatment often confers better activity and especially higher stability on the catalyst in the hydrocracking processes. It can be considered that an erionite or mordenite is really dealuminated when the silicon/aluminum molar ratio is equal to or higher than 10. By way of indication, the dealumination treatment can be performed as follows: the erionite or mordenite is treated at the boiling point for a period of a few hours with a twice normal hydrochloric acid solution, whereupon the solid is filtered, washed and finally dried.

It is desirable to provide a catalyst having good mechanical or crush strength or attrition resistance, because in an industrial environment the catalyst is often subjected to rough handling, which ends to break down the catalyst into powder-like material. The latter causes problems in the processing. Preferably, the zeolite is therefore mixed with a matrix and a binder material and then spray-dried or shaped to the desired shape, such as pellets or extrudates. Examples of suitable binder materials include active and inactive materials and synthetic or naturally occurring zeolites as well as inorganic materials such as clays, silica, alumina, silica-alumina, titania, zirconia and zeolite. Silica and alumina are preferred because these may prevent unwanted side reactions. Preferably, the catalyst comprises, in addition to the zeolite, 2-90 wt %, preferably 10-85 wt % of a binder material.

In some embodiments, the catalyst consists of mordenite or erionite and an optional binder. In other embodiments, the catalyst further comprise one or more metals chosen from group VIb, VIIB and/or VIII of the Periodic Table of Elements. Preferably the catalyst comprises at least one group VIb and/or VIII metals, more preferably at least one group VIII metal.

One preferred catalyst comprises one or more group VIII metals, more preferably one or more VIII noble metals such as Pt, Pd, Rh and Ir, even more preferably Pt and/or Pd. The catalyst preferably comprises in the range of from 0.05 to 10 wt %, more preferably of from 0.1 to 5 wt %, even more preferably of from 0.1 to 3 wt % of such metals, based on the total weight of the catalyst.

Another preferred catalyst comprises at least one group VIB, VIIB and/or VIII metal in combination with one or more other metals, i.e. metals which are not from group VIB, VIIB or VIII. Examples of such combinations of a group VIB, VIIB and VIII in combination with another metal include, but are not limited to PtCu, PtSn or NiCu. The catalyst preferably comprises in the range of from 0.05 to 10 wt %, more preferably of from 0.1 to 5 wt %, even more preferably of from 0.1 to 3 wt % of such metals, based on the total weight of the catalyst.

Yet another preferred catalyst comprises a combination of a group VIB and a group VIII metal. Examples of such combinations of a group VIB and group VIII metal include, but are not limited to, CoMo, NiMo and NiW. The catalyst preferably comprises in the range of from 0.1 to 30 wt %, more preferably of from 0.5 to 26 wt %, based on the total weight of the catalyst.

In the C4 hydrocracking process the hydrocarbon feed stream is contacted with the catalyst at elevated temperatures and elevated pressures. Preferably, the feed stream is contacted with the catalyst at a temperature in the range of 200-650° C., more preferably 250-550° C., most preferably 325-450° C. or 397-510° C. The temperature that is chosen will depend on the composition of the feed stream and the desired product. Preferably, the feed stream is contacted with the catalyst at a pressure of 0.3-10 MPa, more preferably 0.5-6 MPa, most preferably 2-3 MPa.

Preferably, the feed stream is contacted with the catalyst at a weight hourly space velocity (WHSV) of 0.1 to 20 $hr^{-1}$, more preferably 0.5 to 10 $hr^{-1}$. For the C4 hydrocracking the rate of injection is represented by the spatial velocity of introduction of the hydrocarbon charge in liquid form: VVH is the hourly volume rate of flow of charge per volume of catalyst. The value of VVH ranges preferably from 0.1 to 10 $h^{-1}$ and more preferably 0.5 to 5 $h^{-1}$.

The C4 hydrocracking is carried out in the presence of hydrogen. The partial hydrogen pressure in the reaction zone is preferably high; that is within the range of 0.5 to 10 MPa. The partial hydrogen pressure is usually within the range of 2 to 8 MPa and preferably between 2 and 4 MPa.

Hydrogen may be provided in any suitable ratio to the hydrocarbon feed. Preferably, the hydrogen is provided in a molar ratio hydrogen to the hydrocarbon feed of 1:1 to 100:1, more preferably 1:1 to 50:1, more preferably 1:1 to 20:1, most preferably 2:1 to 8:1, wherein the number of moles of the hydrocarbon feed is based on the average molecular weight of the hydrocarbon feed.

A further particularly preferred example of the C4 hydrocracking catalyst comprises sulfided-nickel/H-Erionite1. Heck and Chen (1992), Hydrocracking of n-butane and n-heptane over a sulfide nickel erionite catalyst. Applied Catalysis A: General 86, P83-99, describes such catalyst. The C4 hydrocracking may be performed at conditions comprising a temperature of 397-510° C. and a pressure of 2-3 MPa.

In one embodiment the C4 hydrocracking catalyst consists of a hydrogenated mordenite with a residual proportion of sodium of less than 1% by weight with respect to the dehydrated mordenite, and an optional binder or comprises sulfided-nickel/H-Erionite1 and the C4 hydrocracking is performed under conditions comprising a temperature between 325 and 450° C., a partial hydrogen pressure between 2 and 4 MPa, a molar ratio hydrogen to hydrocarbon feed of 2:1 to 8:1, wherein the number of moles of the hydrocarbon feed is based on the average molecular weight of the hydrocarbon feed and a VVH of 0.5 to 5 $h^{-1}$.

Step c1)

The C4 hydrocracking product stream is subjected to one or more separation steps to obtain a light C4 hydrocracking product stream and a heavy C4 hydrocracking product stream.

The separation for obtaining the light C4 hydrocracking product stream and a heavy C4 hydrocracking product stream may be performed at various points: between iC4 and nC4 or C3 and C4 (i.e. C3 and iC4). The separations respectively provide:

- a light C4 hydrocracking product stream of iC4− hydrocarbons and a heavy C4 hydrocracking product stream of nC4+ hydrocarbons or
- a light C4 hydrocracking product stream of C3− hydrocarbons and a heavy C4 hydrocracking product stream of C4+ hydrocarbons.

Preferably, all of the heavy C4 hydrocracking product stream is recycled back to step c). However, the heavy C4 hydrocracking product stream may be subjected to one or more further separations and only part of the heavy C4 hydrocracking product stream may be recycled back to step c). This forms the third recycle stream.

A light C4 hydrocracking product stream is obtained from the lighter portion of the C4 hydrocracking product stream. Preferably, the light C4 hydrocracking product stream so obtained is used as a final product or subjected to further separations and conversions.

In some preferred embodiments, step c1) includes separating H2 or H2 and C1 from the C4 hydrocracking product stream to be recycled back to step c). This separation may be performed in addition to the separations mentioned above.

Step c2)

The heavy C4 hydrocracking product stream obtained from the C4 hydrocracking product stream is recycled back to step c). This recycled part forms the third recycle stream.

Olefin Synthesis

The C2 and C3 hydrocarbons obtained by the process according to the invention are preferably subjected to olefin synthesis.

As used herein, the term "olefins synthesis" relates to a process for the conversion of alkanes to olefins. This term includes any process for the conversion of hydrocarbons to olefins including, but not limited to non-catalytic processes such as pyrolysis or steam cracking, catalytic processes such as propane dehydrogenation or butane dehydrogenation, and combinations of the two such as catalytic steam cracking.

A very common process for olefins synthesis involves "steam cracking". As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C. and the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

Preferably, the olefins synthesis comprises pyrolysis of ethane and dehydrogenation of propane. The propane comprised can be subjected to propane dehydrogenation to produce propylene and hydrogen, which is a much more carbon efficient method for producing olefins when compared to pyrolysis since in a propane dehydrogenation process, substantially no methane is produced.

By selecting olefins synthesis comprising propane dehydrogenation, the overall hydrogen balance of the process can be improved. A further advantage of integrating dehydrogenation process into the process is that a high-purity hydrogen stream is produced, which can be used as feed to the hydrocrackers used in the process of the invention without expensive purification.

System

In a further aspect, the present invention also relates to a process installation suitable for performing the process of the invention, an example of which is illustrated in FIG. 1.

The present invention therefore relates to a system for producing C2 and C3 hydrocarbons, comprising

- a first hydrocracking unit (101) arranged for performing first hydrocracking of a mixed hydrocarbon feed stream (100) comprising a middle distillate in the presence of a first hydrocracking catalyst to produce a first hydrocracking product stream (107);
- a second hydrocracking unit (103) arranged for performing second hydrocracking of a second hydrocracking feed stream (110) in the presence of a second hydrocracking catalyst to produce a second hydrocracking product stream (108), wherein the second hydrocracking is more severe than the first hydrocracking;
- a C4 hydrocracking unit (105) arranged for performing C4 hydrocracking of a C4 hydrocracking feed stream (112), optimized for converting C4 hydrocarbons into C3 hydrocarbons in the presence of a C4 hydrocracking catalyst to produce a C4 hydrocracking product stream (109), wherein the C4 hydrocracking is more severe than the second hydrocracking;
- a separation system for being fed with the first hydrocracking product stream (107), the second hydrocracking product stream (108) and the C4 hydrocracking product stream (109) and arranged for providing the second hydrocracking feed stream (110) separated from the first hydrocracking product stream (107), the C4 hydrocracking feed stream (112) separated from the second hydrocracking product stream (108), a first recycle stream (301) to be recycled back to the first hydrocracking unit (101), a second recycle stream (302) to be recycled back to the second hydrocracking unit (103), a third recycle stream (303) to be recycled back to the C4 hydrocracking unit (105), a hydrogen recycle stream of H2 or H2 and C1 hydrocarbon to be recycled back to the first hydrocracking unit (101), the second hydrocracking unit (103) or the C4 hydrocracking unit (105) and a C2 and C3 product stream of C3− hydrocarbons (114), wherein the second hydrocracking feed stream is a stream of C12− hydrocarbons excluding C10-C12 hydrocarbons having di-ring structures, wherein the first recycle stream is a stream of C13+ and C10-C12 hydrocarbons having di-ring structures, wherein the C4 hydrocracking feed stream is a stream of C5−, C4− or iC4− hydrocarbons, wherein the second recycle stream is a stream of C6+, C5+ or nC4+ hydrocarbons wherein the third recycle stream is a stream of nC4+ or C4+ hydrocarbons.

The present invention therefore further relates to a system for producing C2 and C3 hydrocarbons, comprising

- a first hydrocracking unit (101) arranged for performing first hydrocracking of a mixed hydrocarbon feed stream (100) comprising a middle distillate in the presence of a first hydrocracking catalyst to produce a first hydrocracking product stream (107);
- a first separation unit (102) for separating the first hydrocracking product stream (107) arranged to provide the second hydrocracking feed stream of C12− hydrocarbons excluding C10-C12 hydrocarbons having di-ring structures and a heavy first hydrocracking product stream (111) of C13+ hydrocarbons and C10-C12 hydrocarbons having di-ring structures, the system being arranged for feeding the heavy first hydrocracking product stream (111) to the first hydrocracking unit (101),
- a second hydrocracking unit (103) arranged for performing second hydrocracking of the second hydrocracking feed stream (110) in the presence of a second hydrocracking catalyst to produce a second hydrocracking product stream (108), wherein the second hydrocracking is more severe than the first hydrocracking;
- a second separation unit (104) for separating the second hydrocracking product stream (108) arranged to provide the C4 hydrocracking feed stream of C5− hydrocarbons and a heavy second hydrocracking product stream of C6+ hydrocarbons, the C4 hydrocracking feed stream of C4− hydrocarbons and a heavy second hydrocracking product stream of C5+ hydrocarbons or the C4 hydrocracking feed stream of iC4− hydrocarbons and a heavy second hydrocracking product stream of nC4+ hydrocarbons, the system being arranged for feeding the heavy second hydrocracking product stream (113) to the second hydrocracking unit (103), a C4 hydrocracking unit (105) arranged for performing C4 hydrocracking of a C4 hydrocracking feed stream (112), optimized for converting C4 hydrocarbons into C3 hydrocarbons in the presence of a C4 hydrocracking catalyst to produce a C4 hydrocracking product stream (109), wherein the C4 hydrocracking is more severe than the second hydrocracking; and a third separation unit (106) for separating the C4 hydrocracking product stream (109) arranged to provide a light C4 hydrocracking product stream of iC4− hydrocarbons and a heavy C4 hydrocracking product stream of nC4+ hydrocarbons or a light C4 hydrocracking product stream of C3− hydrocarbons and a heavy C4 hydrocracking product stream of C4+ hydrocarbons, the system being arranged for feeding the heavy C4 product stream (115) to the C4 hydrocracking unit (105).

The system according to the invention may further comprise a third hydrocracking unit (201) arranged for performing third hydrocracking of a part (200) of the heavy second hydrocracking product stream in the presence of a third hydrocracking catalyst to produce a third hydrocracking product stream (202) comprising BTX and which is substantially free from non-aromatic C6+ hydrocarbons, wherein the third hydrocracking is more severe than the second hydrocracking and less severe than the C4 hydrocracking.

The separation units (300; 102; 104; 106) may use any known technology for the separation of a mixed hydrocarbon stream, for example, gas-liquid separation, distillation or solvent extraction.

Each of the separation units (300; 102; 104; 106) may be one fractionating column having outlets for different hydrocarbon streams or a combination of multiple fractionating columns. For example, the first separation unit (102) may comprise a fractionating column having respective outlets for the hydrocarbon stream (204) to be fed to the C4 hydrocracking unit (105), the second hydrocracking feed stream (110) to be fed to the second hydrocracking unit (103) and the heavy first hydrocracking product stream (111) to be recycled back to the first hydrocracking unit (101).

In other embodiments, the first separation unit (102) comprises a first column having an outlet for the hydrocarbon stream (204) to be fed to the C4 hydrocracking unit (105) and an outlet for the remainder; and a second column having an inlet connected to the outlet for the remainder of the first column, an outlet for the a second hydrocracking feed stream (110) and an outlet for the heavy first hydrocarbon product stream (111).

FIG. 1 is hereinafter described in detail. FIG. 1 schematically illustrates a system comprising a first hydrocracking unit 101, a second hydrocracking unit 103, a C4 hydrocracking unit 105 and a separation system 300.

As shown in FIG. 1, a mixed hydrocarbon feed stream 100 is fed to the first hydrocracking unit 101 which produces a first hydrocracking product stream 107. The first hydrocracking product stream 107 is fed to the separation system 300, which produces a second hydrocracking feed stream 110 of C12− hydrocarbons excluding C10-C12 hydrocarbons having di-ring structures.

The second hydrocracking feed stream 110 is fed to the second hydrocracking unit 103, which produces a second hydrocracking product stream 108. The second hydrocracking product stream 108 is fed to the separation system 300, which produces a C4 hydrocracking feed stream 112 (e.g. of C4− hydrocarbons).

The C4 hydrocracking feed stream 112 is fed to the C4 hydrocracking unit 105, which produces a C4 hydrocracking product stream 109. The C4 hydrocracking product stream 109 is fed to the separation system 300.

The separation system 300 further produces a first recycle stream 301 of C13+ and C10-C12 hydrocarbons having di-ring structures to be recycled back to the first hydrocracking unit 101, a second recycle stream 302 (e.g. of C5+) to be recycled back to the second hydrocracking unit 103, a third recycle stream 303 of (e.g. of C4+) to be recycled back to the C4 hydrocracking unit 105, a hydrogen recycle stream (not shown) of H2 or H2 and C1 to be recycled back to the first hydrocracking unit 101, the second hydrocracking unit 103 and/or the C4 hydrocracking unit 105 and a C2 and C3 product stream 114 of C3− hydrocarbons.

Figure 2:
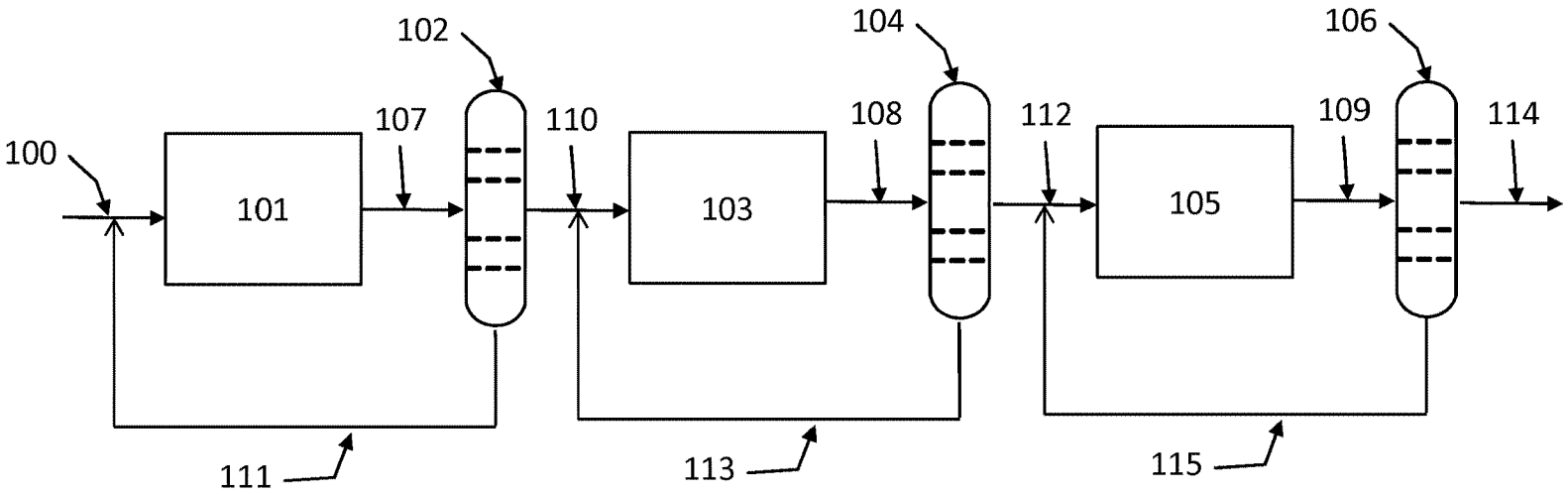

FIG. 2 illustrates a further embodiment of the system of the invention. FIG. 2 schematically illustrates a system comprising a first hydrocracking unit 101, a first separation unit 102, a second hydrocracking unit 103, a second separation unit 104, a C4 hydrocracking unit 105 and a third separation unit 106.

As shown in FIG. 2, a mixed hydrocarbon feed stream 100 is fed to the first hydrocracking unit 101 which produces a first hydrocracking product stream 107. The first hydrocracking product stream 107 is fed to the first separation unit 102, which produces a second hydrocracking feed stream 110 of C12− hydrocarbons excluding C10-C12 hydrocarbons having di-ring structures and a heavy first hydrocracking product stream 111 of C13+ hydrocarbons and C10-C12 hydrocarbons having di-ring structures. The heavy first hydrocracking product stream 111 of C13+ hydrocarbons and C10-C12 hydrocarbons having di-ring structures is recycled back to the first hydrocracking unit 101.

In this embodiment, the first separation unit 102 performs only the separation to provide the second hydrocracking feed stream 110 and the heavy first hydrocracking product stream 111. Accordingly, the second hydrocracking feed stream 110 comprises H2 and C1-C12 hydrocarbons excluding C10-C12 hydrocarbons having di-ring structures and is fed to the second hydrocracking unit 103.

The second hydrocracking unit 103 produces a second hydrocracking product stream 108. The second hydrocracking product stream 108 is fed to the second separation unit 104, which produces a C4 hydrocracking feed stream 112 (e.g. of C4− hydrocarbons) and a heavy first hydrocracking product stream 113 of (e.g. of C5+ hydrocarbons). The heavy first hydrocracking product stream 113 (e.g. of C5+ hydrocarbons) is recycled back to the second hydrocracking unit 103.

In this embodiment, the second separation unit 104 performs only the separation to provide the C4 hydrocracking feed stream 112 and the heavy first hydrocracking product stream 113. Accordingly, the C4 hydrocracking feed stream 112 comprises H2 and C1-C4 hydrocarbons and is fed to the C4 hydrocracking unit 105.

The C4 hydrocracking unit 105 produces a C4 hydrocracking product stream 109. The C4 hydrocracking product stream 109 is fed to the third separation unit 106, which produces a light C4 hydrocracking product stream 114 (e.g. of C3− hydrocarbons) and a heavy C4 hydrocracking product stream 115 (e.g. of C4+ hydrocarbons). The heavy first hydrocracking product stream 115 (e.g. of C4+ hydrocarbons) is recycled back to the C4 hydrocracking unit 105.

In this embodiment, the third separation unit 106 performs only the separation to provide the light C4 hydrocracking product stream 114 and the heavy C4 hydrocracking product stream 115. Accordingly, the light C4 hydrocracking product stream 114 comprises H2 and C1-C3 hydrocarbons. The light C4 hydrocracking product stream 114 may be further separated to provide a recycle stream of H2 and C1 hydrocarbon and a stream of C2-C3 hydrocarbons (not shown).

Figure 3:
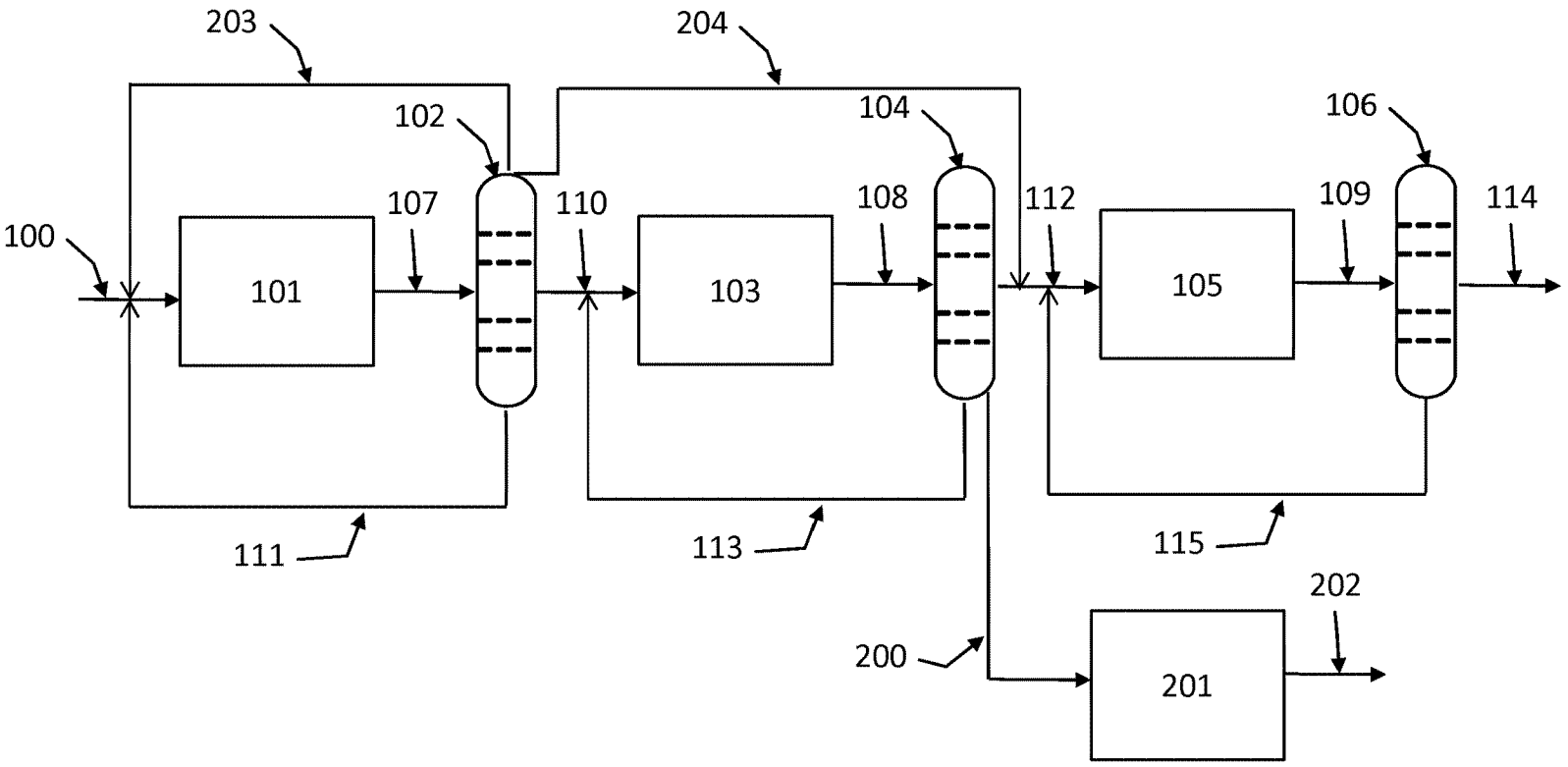

FIG. 3 illustrates a further embodiment of the system of the invention. FIG. 3 is identical to FIG. 2 except that system further comprises a third hydrocracking unit 201 for receiving part 200 of the second hydrocracking product stream. A further difference in FIG. 3 with respect to FIG. 2 is that the first separation unit 102 produces a stream 203 of H2 and C1 and a stream 204 of C2-C4 in addition to a second hydrocracking feed stream 110 of C5-C12 excluding C10-C12 hydrocarbons having di-ring structures and a heavy first hydrocracking product stream 111 of C13+ and C10-C12 hydrocarbons having di-ring structures. The stream 203 is recycled back to the first hydrocracking unit 101. The stream 204 is fed to the C4 hydrocracking unit 105. A further difference in FIG. 3 with respect to FIG. 2 is that the second hydrocracking unit 104 produces a C4 hydrocracking feed stream 112 of H2 and C1-C4 and a heavy second hydrocracking product stream in the form of two streams 113 and 200. The part 113 of the heavy second hydrocracking product stream is a stream of C5 and is recycled back to the second hydrocracking unit 104. The part 200 of the heavy second hydrocracking product stream is a stream of C6+ hydrocarbons and is fed to the third hydrocracking unit 201 which produces a third hydrocracking product stream 202 comprising BTX and substantially free of non-aromatic C6+ hydrocarbons.

The invention claimed is:

1. A process for producing C2 and C3 hydrocarbons, comprising a) subjecting a mixed hydrocarbon stream comprising a middle distillate to first hydrocracking in the presence of a first hydrocracking catalyst to produce a first hydrocracking product stream, b) subjecting a second hydrocracking feed stream to a second hydrocracking in the presence of a second hydrocracking catalyst to produce a second hydrocracking product stream, wherein the second hydrocracking is more severe than the first hydrocracking and c) subjecting a C4 hydrocracking feed stream to C4 hydrocracking optimized for converting C4hydrocarbons into C3 hydrocarbons in the presence of a C4 hydrocracking catalyst to obtain a C4 hydrocracking product stream, wherein the C4 hydrocracking is more severe than the second hydrocracking, wherein the first hydrocracking product stream, the second hydrocracking product stream and the C4 hydrocracking product stream are fed to a separation system which provides:

the second hydrocracking feed stream separated from the first hydrocracking product stream, the C4 hydrocracking feed stream separated from the second hydrocracking product stream, a first recycle stream which is recycled back to the first hydrocracking, a second recycle stream which is recycled back to the second hydrocracking, a third recycle stream which is recycled back to the C4 hydrocracking, a hydrogen recycle stream of H2 or H2 and methane which is recycled back to the first hydrocracking, the second hydrocracking and/or the C4 hydrocracking and a C2 and C3 product stream of C3− hydrocarbons, wherein the second hydrocracking feed stream is a stream of C12− hydrocarbons excluding C10- C12 hydrocarbons having di-ring structures, wherein the first recycle stream is a stream C13+ hydrocarbons and C10-C12 hydrocarbons having di-ring structures, wherein the C4 hydrocracking feed stream is a stream of C5−, C4− or iC4hydrocarbons, wherein the second recycle stream is a stream of C6+, C5+ or nC4+ hydrocarbons, and wherein the third recycle stream is a stream of nC4+ or C4+ hydrocarbons.

2. The process according to claim 1, comprising:

a) subjecting a mixed hydrocarbon stream comprising a middle distillate to the first hydrocracking in the presence of the first hydrocracking catalyst to produce a first hydrocracking product stream, a1) subjecting the first hydrocracking product stream to one or more separation steps to obtain the second hydrocracking feed stream of C12− hydrocarbons excluding C10-C12 hydrocarbons having di-ring structures and the first recycle stream, a2) recycling at least part of the first recycle stream to step a), b) subjecting a second hydrocracking feed stream to the second hydrocracking in the presence of a second hydrocracking catalyst to produce a second hydrocracking product stream, wherein the second hydrocracking is more severe than the first hydrocracking, b1) subjecting the second hydrocracking product stream to one or more separation steps to obtain:

the C4 hydrocracking feed stream of C5− hydrocarbons and a second recycle stream of C6+ hydrocarbons, the C4 hydrocracking feed stream of C4− hydrocarbons and a second recycle stream of C5+ hydrocarbons, or the C4 hydrocracking feed stream of iC4− hydrocarbons and a second recycle stream of nC4+ hydrocarbons;

b2) recycling at least part of the second recycle stream to step b), c) subjecting the C4 hydrocracking feed stream to the C4 hydrocracking, c1) subjecting the C4 hydrocracking product stream to one or more separation steps to obtain:

a light C4 hydrocracking product stream of iC4− hydrocarbons and a third recycle stream of nC4+ hydrocarbons or a light C4 hydrocracking product stream of C3− hydrocarbons and a third recycle stream of C4+ hydrocarbons; and c2) recycling at least part of the third recycle stream to step c).

3. The process according to claim 2, wherein step a1) includes a separation between C4 and C5 hydrocarbons to obtain:

a stream of C4− hydrocarbons; and wherein the second hydrocracking feed stream comprises C5-C12 hydrocarbons, and wherein the stream of C4− hydrocarbons is subjected to the C4 hydrocracking of step c).

4. The process according to claim 2, wherein step a1) includes a separation between C3 and C4 hydrocarbons to obtain:

a stream of C3− hydrocarbons; and the second hydrocracking feed stream, wherein the second hydrocracking feed stream comprises C4-C12 hydrocarbons.

5. The process according to claim 4, wherein the second hydrocracking catalyst is a catalyst containing at least one metal selected from the group consisting of group VIII, group VIB and group VIIB of the periodic classification of elements, wherein the metal is deposited on a carrier.

6. The process according to claim 2, wherein step b1) includes a separation between C3 and C4 hydrocarbons to obtain: a stream of C3− hydrocarbons; and the C4 hydrocracking feed stream.

7. The process according to claim 2, wherein the process further comprises the step of subjecting a part of the second recycle stream to a third hydrocracking cracking in the presence of a third hydrocracking catalyst to produce a third hydrocracking product stream which is substantially free from non-aromatic C6+ hydrocarbons, wherein the third hydrocracking is more severe than the second hydrocracking and less severe than the C4 hydrocracking.

8. The process according to claim 2, wherein: step a1) includes a separation of H2or H2 and methane from the first hydrocracking product stream, step b1) includes a separation of H2 or H2 and methane from the second hydrocracking product stream, and/or step c1) includes a separation of H2 or H2 and methane from the C4 hydrocracking product stream.

9. The process according to claim 1, wherein the second hydrocracking is a hydrocracking process suitable for converting a hydrocarbon feed comprising naphthenic and paraffinic hydrocarbon compounds to a stream rich in LPG and aromatic hydrocarbons.

10. The process according to claim 1, wherein the C4 hydrocracking catalyst comprises a mordenite or erionite.

11. The process according to claim 1, wherein the C4 hydrocracking catalyst consists of mordenite and an optional binder or comprises sulfided-nickel/H-Erionite and the C4 hydrocracking is performed under conditions comprising a temperature between 325 and 450° C., a hydrogen partial pressure between 2 and 4 MPa, a molar ratio of hydrogen to hydrocarbon feed of 2:1 to 8:1, wherein the number of moles of the hydrocarbon feed is based on the average molecular weight of the hydrocarbon feed and a VVH of 0.5 to 5 $h^{-1}$.

12. The process according to claim 1, wherein the amount of methane in the first hydrocracking product stream is at most 5 wt %.

13. The process according to claim 1, wherein the amount of methane in the second hydrocracking product stream is at most 5 wt %.

14. The process according to claim 1, wherein the amount of the C2-C3 hydrocarbons in the C4 hydrocracking product stream is at least 60 wt %.

15. The process according to claim 1, wherein the second hydrocracking catalyst is a catalyst containing at least one metal selected from the group consisting of group VIII, group VIB and group VIIB of the periodic classification of elements, wherein the metal is deposited on a carrier.

16. The process according to claim 1, wherein the C4 hydrocracking catalyst consists of mordenite and a binder.

17. The process according to claim 1, wherein the C4 hydrocracking catalyst comprises sulfided-nickel/H-Erionite and the C4 hydrocracking is performed under conditions comprising a temperature between 325 and 450° C., a hydrogen partial pressure between 2 and 4 MPa, a molar ratio of hydrogen to hydrocarbon feed of 2:1 to 8:1, wherein the number of moles of the hydrocarbon feed is based on the average molecular weight of the hydrocarbon feed and a VVH of 0.5 to 5 h−1.

18. The process according to claim 2, wherein the second hydrocracking catalyst is a catalyst containing at least one metal selected from the group consisting of group VIII, group VIB and group VIIB of the periodic classification of elements, wherein the metal is deposited on a carrier.

19. The process according to claim 3, wherein the second hydrocracking catalyst is a catalyst containing at least one metal selected from the group consisting of group VIII, group VIB and group VIIB of the periodic classification of elements, wherein the metal is deposited on a carrier.

20. The process according to claim 19, wherein the amount of methane in the first hydrocracking product stream is at most 5 wt %.

* * * * *